US005871118A

United States Patent [19]

Franzese

[11] Patent Number: 5,871,118

[45] Date of Patent: Feb. 16, 1999

[54] ERGONOMIC REUSABLE TOP FOR BEVERAGE CONTAINERS

[75] Inventor: Antonio Franzese, Cedarhurst, N.Y.

[73] Assignee: Bottoms Up, Inc., Great Neck, N.Y.

[21] Appl. No.: 846,106

[22] Filed: Apr. 25, 1997

Related U.S. Application Data

[63] Continuation-in-part of Ser. No. 453,809, May 30, 1995, abandoned, which is a continuation-in-part of Ser. No. 431,256, Apr. 11, 1995, abandoned.

[51] Int. Cl.[6] ..... B65D 25/48

[52] U.S. Cl. ..... 220/717; 220/718; 220/713; 220/DIG. 13

[58] Field of Search ..... 220/703, 711, 220/713, 716, 717, 718, 906, DIG. 13, 4.03

[56] References Cited

U.S. PATENT DOCUMENTS

| | | | |
|---|---|---|---|
| 2,059,070 | 10/1936 | Wershay | 220/717 |
| 2,075,721 | 3/1937 | Hommel | 220/717 |
| 2,203,476 | 6/1940 | Trabold | 220/717 |
| 2,725,732 | 12/1955 | Somoza | 220/718 |
| 4,146,157 | 3/1979 | Dixon, Sr. et al. | 220/717 |
| 5,071,042 | 12/1991 | Esposito | 220/711 |
| 5,467,888 | 11/1995 | Brandstrom et al. | 220/717 |
| 5,542,670 | 8/1996 | Morano | 220/717 |

FOREIGN PATENT DOCUMENTS

| | | |
|---|---|---|
| No. 601.402 | 11/1925 | France . |
| No. 1.437.341 | 3/1966 | France . |
| N. 317280 | 5/1934 | Italy . |
| 406092341 A | 5/1994 | Japan . |

*Primary Examiner*—Stephen J. Castellano
*Attorney, Agent, or Firm*—Graham & James LLP

[57] ABSTRACT

A plastic beverage container attachment of the present invention having a curved or beveled section is releasably attachable at its base to the top of a metal or aluminum beverage can, or to the top of a plastic or Styrofoam drink cup or container. The interior of the beveled portion of the attachment comprises an internal concave portion or reservoir, and curved funneled surfaces, that hold and regulate the volume and rate of flow of the beverage and thus inhibit its sudden rush from the container to the drinker's mouth, thus permitting the consumer to enjoy a more gentle beverage flow. An edge is molded around the interior of the base of the container to enable the attachment to firmly snap on and off the top of the container or can. A series of posts or projections are placed around the interior of the base, just above the edge, so as to aid in the support of the attachment on the can or container. A lip or lever is molded to the outside of the base of the attachment to facilitate the removal of the attachment from the top of the can or container by the user. In addition, a conventional aluminum beverage can is modified to provide similar ergonomic and liquid flow control features.

8 Claims, 8 Drawing Sheets

ERGONOMIC REUSABLE TOP FOR BEVERAGE CONTAINERS

This application is a continuation-in-part application of U.S. Ser. No. 08/453,809, filed May 30, 1995, now abandoned , which is a continuation-in-part application of U.S. Ser. No. 08/431,256, filed Apr. 11, 1995, now abandoned, both entitled "AN ERGONOMIC CONTAINER FOR LIQUIDS AND OTHER POURABLE MATERIALS".

BACKGROUND OF THE INVENTION

1. Field of the Invention

The field of the present invention relates to tops that can be attached to beverage containers including, but not limited to, beverage cans and plastic cups that are used to contain soda, juices, fruit drinks, beer, and the like. In particular, the beverage can and container tops of this invention employ a beveled design with an internal reservoir and curved funnel surfaces that provide the consumer with a means for drinking from the container on the go, without having to unduly tilt her head, together with a smooth and controlled flow of the beverage.

2. Description of the Prior Art.

Most beverages, other liquids, and non-liquid materials capable of being poured, such as detergents, are stored and/or sold in containers such as the familiar aluminum soda and beer cans, and plastic cups found on the shelves of supermarkets and convenience stores and at sports stadiums and amusement parks. In the case of beverage cans, these containers are constructed in the form of a straight cylinder having a flat or concave base and a substantially flat top parallel to the base with a small frangible area that can be pulled off or folded into the interior of the container so that the contents thereof can be emptied into a glass and consumed or drunk with a straw. The large and small plastic cup containers that contain soda and beer sold in fast food restaurants, ball parks, gas stations, and other public places, are also of a straight or "V" cylindrical shape and must utilize a substantially flat top or lid in order to take the beverage on the go. In some instances, such lids contain a simple and somewhat inconvenient "tear-off" portion that allows the beverage to be drunk in the car or while walking.

In today's fast pace society, it is desirable to be able to drink beverages directly from the container, without first pouring them into a drinking glass, cup or other vessel. This is especially the case when a beverage is drunk "on-the-go", i.e., in a car, outdoors, or in places where a drinking glass is not available. At the same time, it is also necessary to have the beverage well-contained such that it does not jump out and spill over the user.

However, a problem exists with the ergonomics of conventional beverage can and flat top containers. When the conventional beverage can or container is placed at the lips and tipped upwards for drinking, the drinker must maneuver or tilt her head backwards in order to consume the entire beverage. This is because the degree of upward tipping of the straight can that must be achieved in order to pour the beverage into the drinker's mouth has been blocked by the direct contact of the can's flat top with the drinker's nose. One often sees, for example in a soft drink television commercial, the subject drawing her head backwards in order to sip or chug her favorite soft drink directly from its can or cup. Thus, the shape and configuration of existing beverage can technology restricts the degree to which a conventional beverage can, when placed at one's lips, can be tipped backwards, and requires that a drinker compensate for this restriction by tilting her head backwards (or otherwise maneuvering it) to allow all of the beverage to enter her mouth. This difficulty in drinking directly from the conventional beverage can is heightened by the fact that tipping the can back too far results in too much beverage at the can's opening and thus inhibits the entry of air into the can's interior, which must occur in order to facilitate the emptying of the beverage. In addition, when the drinker tilts her head back too far, the beverage has a tendency to rush towards her lips, spilling onto the chin and possibly soiling her clothes.

Attempts to solve the "ergonomic" problems of the conventional straight cylindrical beverage cans and containers have not been very successful. U.S. Pat. No 4,728,002 to Ybanez discloses a straight cylindrical beverage can having a sharp angled top which is claimed to make it unnecessary for one drinking from the can to tilt her head back. However, the Ybanez can suffers from many disadvantages. First, Ybanez does not completely solve the aforementioned problem presented by the beverage cans of the prior art because it only permits the can to be tipped to a 90 degree angle relative to the drinker's face before contacting the drinker's nose. See Ybanez FIG. 3. This is not enough to easily discharge all of the beverage into the drinker's mouth and the drinker must still tilt her head back to compensate for this restriction Second, the Ybanez can presents a sharp or pointed edge to the drinker's lips which makes the can potentially unsafe for drinking directly therefrom. For example, drinking a beverage from the Ybanez can would subject the drinker to injury from the can's sharp edge if the drinker were jostled in a moving car or nudged in a crowded room. Third, Ybanez's sharp-angled top permits the exiting beverage to drip over the side of the can as Ybanez does not disclose or teach a lip or reservoir in the can to prevent the beverage from spilling before it enters into the drinker's mouth.

U.S. Pat. No. 1,773,291 to Weaver discloses a tapered glass bottle. Weaver is similar to Ybanez in that it utilizes angled flat top portion of a one-piece bottle which is claimed to make it unnecessary for one drinking from the bottle to tilt her head back. Weaver appears to have modified then-existing bottle design to shorten one side portion of the bottle neck, while leaving the other substantially intact, so as to form an angled top. However, while the outside of Weaver neck is a solid bulge, Weaver does not teach or disclose an internal curvature within the bottle so as to form a reservoir. The interior of Weaver was designed to remain straight. See Weaver FIGS. 5, 7, 8 and 9.

U.S. Pat. No. 5,071,042 to Esposito, discloses a bottle-like tapered adapter for a beverage can having a top portion that is parallel to the base portion, and which is said to provide a sanitary mouthpiece as an alternative to drinking directly from the top of unclean cans. The Esposito adapter claims to achieve this by using a plate and gasket assembly that prevents the beverage from contacting the top of the can. Esposito does not, however, disclose a reusable top that is beveled in relation to the base, nor an attachment which employs an internal reservoir and curved funnel surfaces for controlling the flow of beverage during drinking. Similarly, U.S. Pat. No. 828,817 to Harrington discloses a straight conical cap for bottles whose top surface is parallel to its base, and does not teach or suggest the novel features of the present invention.

French Pat. No. 1,437,341 to Turnwald discloses a metal infant goblet assembled from three separate parts: a first part for holding the liquid and providing a base, a second part consisting of a gasket, i.e., a garniture, having a series of holes that regulate the rate of flow of liquid leaving the first portion, and a third part that fits over the gasket and apparently from which the infant is fed. The third Turnwald part has an opening for drinking at the end of an angle top that is substantially parallel to the side of the base portion. However, while Turnwald discloses a angled spout, it does not disclose or suggest an internal reservoir for controlling the flow of liquid to the mouth opening. Instead, Tumnwald utilizes a gasket having holes therein to control the rate of flow of liquid during drinking. See Turnwald page 1, last sentence running to top of page 2.

Additional prior art also fails to the novel features of the Applicant's invention. U.S. Pat. No. 5,409,131 to Phillips et. al. discloses a drinking lid for a disposable coffee cup with a domed cover and a "flexible spout" made of accordion-like pleats or folds. The pleats or folds of Phillips et al. apparently enable the spout to be bent like a conventional drinking straw so that the end of the spout can engage with the mouth of the individual. (Phillips et al. Col. 2, lines 23–24). Unlike the present invention, Phillips et al. does not teach or suggest to one of ordinary skill a beverage container attachment with a substantially rigid, beveled shaped portion having a an internal reservoir therein, which is made of one smooth curved piece, instead of pleats and folds.

In sum, the prior art fails to disclose a removable and reusable top having an interior reservoir and funneled surfaces in a beveled section that holds the beverage and regulates its volume and flow, inhibits its sudden rush from the container to the drinker's mouth, and thereby permits the drinker to employ a more gentle sipping action during drinking.

SUMMARY OF THE INVENTION

A high density plastic beverage container attachment of the present invention having a curved or beveled section is releasably attachable at its base to the top of a metal or aluminum beverage can, or to the top of a plastic or Styrofoam drink cup or container. The interior of the attachment comprises at least one internal concave portion or reservoir, and curved funnel surfaces, that combine to hold and regulate the volume and rate of flow of the beverage, and thus inhibit its sudden rush from the container to the drinker's mouth, thus permitting the consumer to enjoy a more gentle beverage flow. A second convex portion may be juxtaposed to the concave reservoir portion to allow the attachment to be tilted higher towards the drinker's nose. An edge is molded around the interior of the base of the container to enable the attachment to firmly snap on and off the top of the container or can. In addition, a series of posts or projections are placed around the interior of the base, just above the edge, so as to aid in the support of the attachment on the can or container. A lip or lever is molded to the outside of the base of the attachment to facilitate the removal of the attachment from the top of the can or container by the user.

By virtue of the aforementioned design, the consumer is provided with a removable and reusable beverage container attachment that allows her to easily employ a gentle sipping action, and does require her to substantially move her head in order to drink her favorite juice or soft drink while driving or otherwise on the go.

In an alternative embodiment, a conventional beverage can or container can be modified to form a top portion that has the features of the attachment. In this embodiment, the can has a first portion extending from the base that is capable of storing at least a portion of the container's contents, a second portion extending from the first portion being at least partially beveled or curved to a degree in relation to the first portion such that a drinker is not required to maneuver her head in order to drink the contents when the container is placed at the drinker's lips, and a third portion covering at least a part of the second portion but being capable of dispensing its contents.

OBJECTS OF THE INVENTION

One object of the present invention is to provide an ergonomic beverage container attachment that allows the consumer to drink a beverage in an enjoyable and controlled manner and without requiring her to significantly maneuver or tilt her head during drinking.

A second object of the invention is to provide an ergonomic beverage container attachment that reduces the degree to which a person has to avert her eyes from her surroundings while drinking therefrom thus making it safe to drink a soft drink from the can or container while in motion.

A third object of the invention is to provide an ergonomic beverage container attachment with an internal reservoir and curved funnel surfaces that permit a more gentle sipping action by the drinker.

A fourth object of the invention is to provide an ergonomic beverage container attachment that inhibits the sudden rush of its contents to the drinker's mouth so that they are less likely to drip onto the drinker's chin and clothing.

A fifth object of the invention is to provide a beverage container attachment that can deliver a liquid flow to a drinker's lips in a controlled manner which is particularly advantageous in feeding small children, the disabled, the sick or the injured.

A sixth objection of the invention is to provide an attachment-container assembly that greatly contains a liquid or beverage even when the same is dropped or knocked over, and allows very little beverage to escape.

A seventh object of the invention is to provide an improved conventional beverage can or container as described above.

The nature of the invention described herein, as well as other objects, uses, and advantages thereof, will clearly appear from the following description and accompanying drawings which are given as examples, for illustrative purposes only, and are not intended to limit the scope of the invention.

DETAILED DESCRIPTION OF THE DRAWINGS AND PREFERRED EMBODIMENTS

Figure 1:
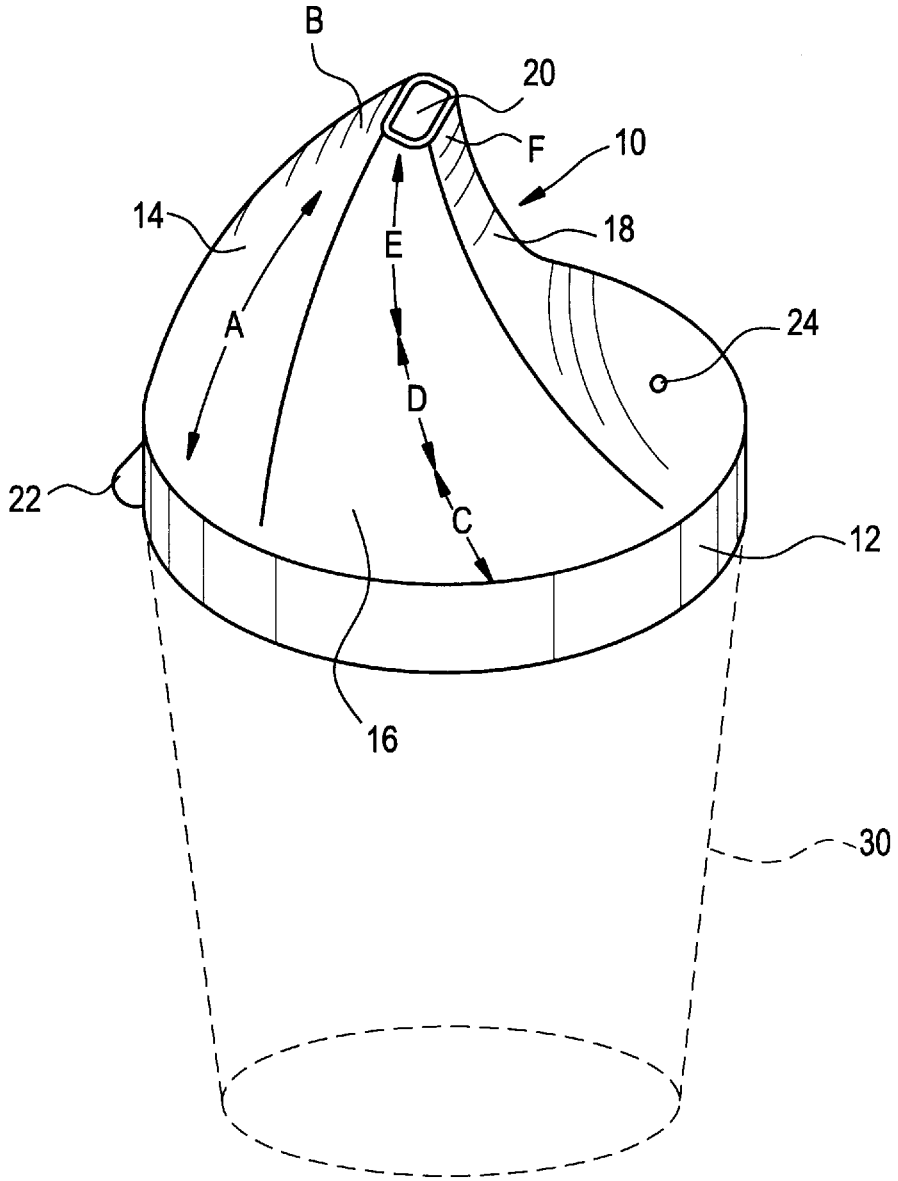
FIG. 1 depicts a perspective view of the exterior of a beverage container attachment of the present invention fixed to the top of an ordinary beverage container.

FIG. 1 is a depiction of an exterior view of a hollow container attachment 10 made of a medium to hard density plastic coming within the scope of the present invention, and being attached to the top of an ordinary beverage container 30 shown in broken lines. Attachment 10 can be made using conventional plastic molding, and heat molding, techniques, well known to those of skill in the beverage container and similar industries.

As shown in FIG. 1, attachment 10 has a base portion 12, from which extend various surfaces 14, 16 and 18 (described below), that in turn extend upwards to an opening 20 at the attachment's apex. Attachment 10 may be snapped on and off container 30 by means of lever or lip 22 extending outwardly from base 12. In addition, attachment 10 has a vent 24 placed near the bottom of surface 18, near base 12, to allow air to flow in and out of attachment 10 to facilitate drinking of the beverage. Vent 24 can vary in placement and size; the optimum size ranges from about 0.4 mm to about 1 mm in diameter. The rate of beverage flow increases with increasing vent size. Base 12 in this embodiment is substantially circular with a diameter of about 4 inches and fits a large size plastic drinking container or cup. A diameter of about 2 inches will fit some aluminum beverage cans. Opening 20 may be of variable size and shape so as to comfortably accommodate the size of the drinker's mouth. When the opening is small relative to the size of the attachment and beverage container, an attachment/container assembly is provided that allows very little beverage to escape when the same is dropped or knocked over. In this embodiment opening 20 is of an elliptical shape and is about ⅞th of an inch wide and about ¼ inch high. The size of the opening may be varied using conventional molding techniques known to those in the art, using e.g., different mold sizes, shapes, configurations, or by using conventional cutting and/or shaping tools and techniques.

Figure 5:
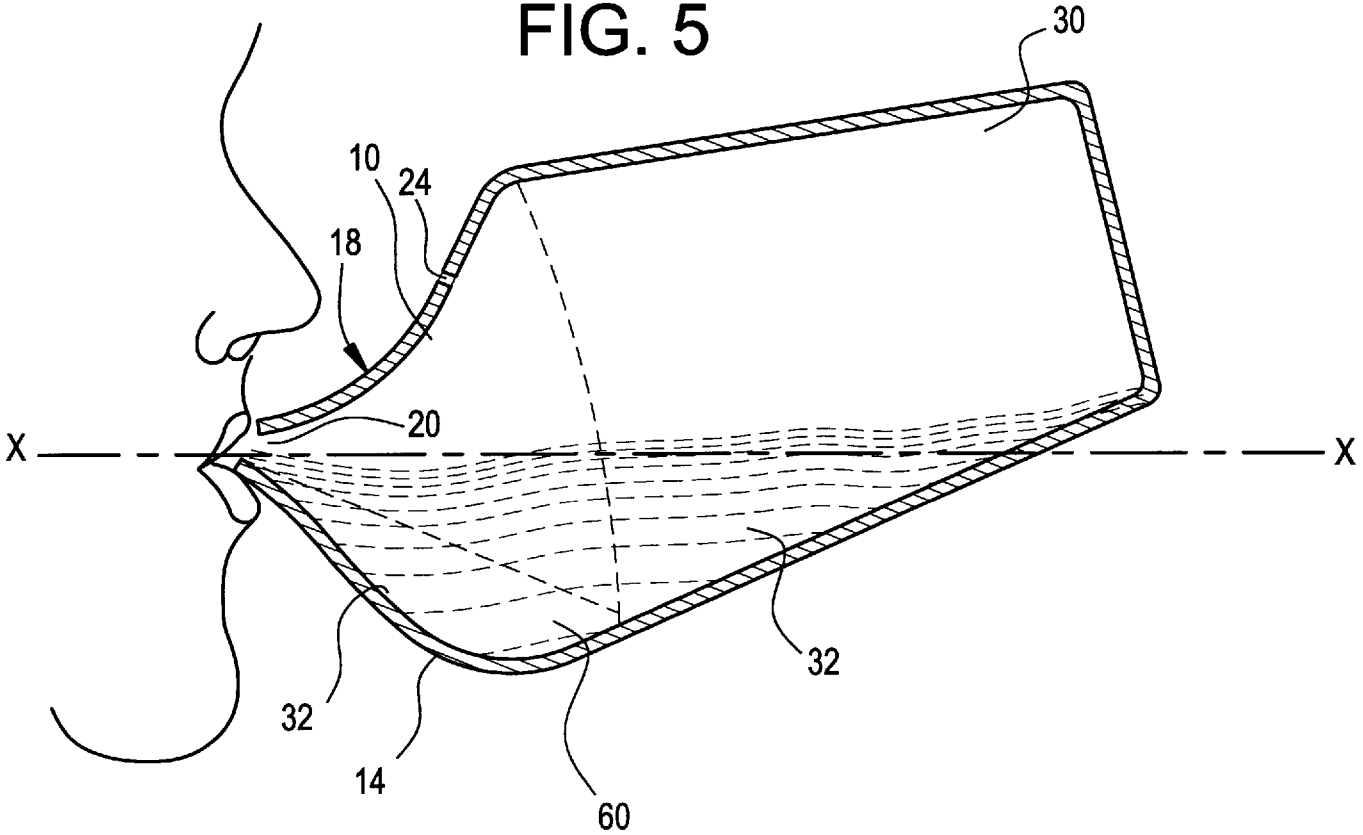
FIG. 5 depicts a cross sectional view of the attachment-beverage container assembly of the present invention about three-quarters full with beverage and being tilted up at the mouth of a consumer above the horizontal level.

In this view, looking at the FIG. 1 from left to right, exterior surface 14, is situated at the back of the attachment 10 and is a convex surface corresponding to the interior concave surface 60 (see FIG. 3) that forms the internal reservoir of attachment 10. In this embodiment, convex surface 14 is a rounded, smooth curve for almost all of its length, as shown in the area designated "A," but may flatten at a small portion slightly below opening 20, as is shown in the area designated "B." Two exterior side surfaces 16 extend from base 12 at each side of attachment 10. Side surfaces 16 are concave surfaces that correspond to interior convex surfaces 70 (see FIG. 3) that form the interior funnels which aid in the channeling of liquid into internal reservoir 60 during drinking. Exterior side surfaces 16 extend upwards from base 12 first at a relatively flat or gentle radius, shown in area C, to a deeper concavity shown in area D, and then rise sharply, in an almost straight manner, upwards, as shown in area E, to opening 20. Front exterior surface 18 is also concave for virtually its entire length except that it may flatten at a point slightly below opening 20, as shown in the area designated "F." Front exterior surface may be widely varied in configuration. However, as shown in FIG. 5, front exterior surface 18 should have a deep enough concavity so as to enable the consumer to tip the attachment upward without having it press against her nose during drinking. In this embodiment, front exterior surface 18 is about ¼ inches deep.

Figure 2:
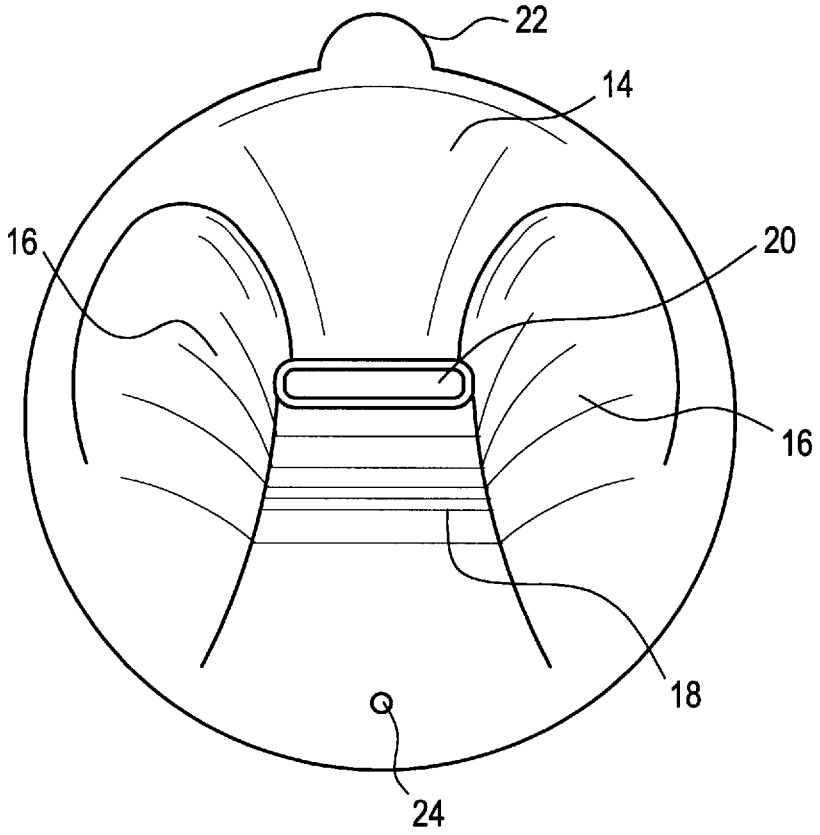
FIG. 2 depicts a top view of the exterior of a beverage container attachment of the present invention.

FIG. 2 depicts the exterior of attachment 10 viewed from the top, showing surfaces 14, 16 and 18, opening 20, tab 22, and vent 24.

Figure 3:
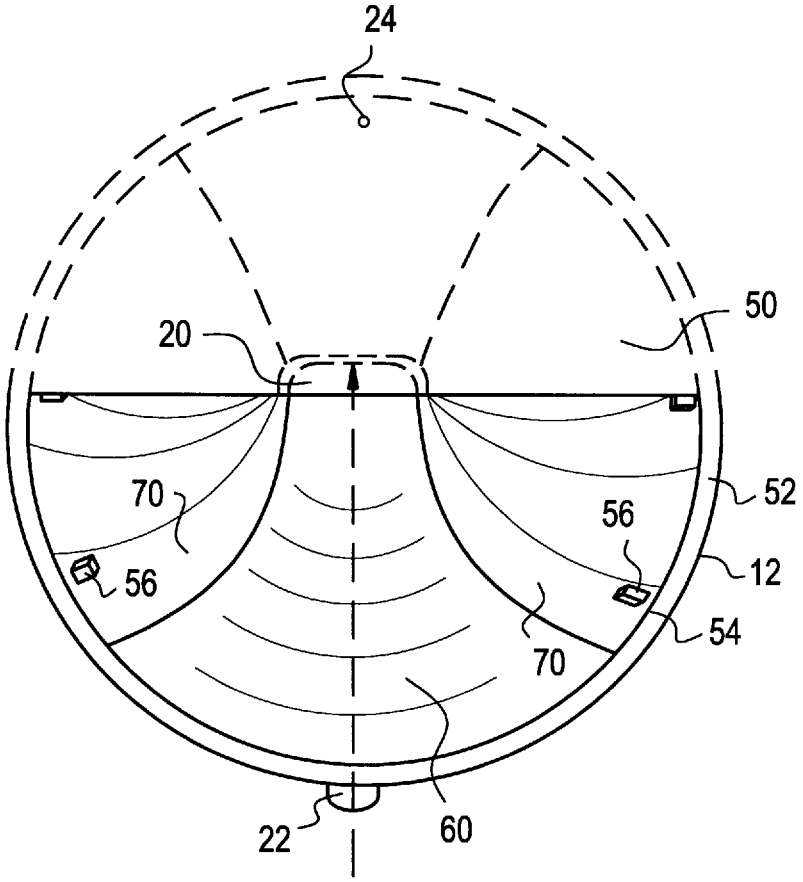
FIG. 3 depicts a partial cut-away perspective showing the interior surfaces of a beverage container attachment of the present invention.

FIG. 3 is a partial cut-away bottom view showing the interior of attachment 10 when viewed through base 12 into hollow cavity 50, generally. As shown, an interior surface 52 is placed around the periphery of the interior of base 12. About ¼ inch upwards from the lower edge of base 12 is edge 54 which is used to releasably secure attachment 10 to the top edge of container 30. Edge 54 is molded into the interior of attachment 10 using conventional molding techniques and enables attachment 10 to snap on and off container 20. The edge 54 is just large enough to catch and hold onto the lip of a conventional plastic container or aluminum can. In some embodiments, the edge 54 may also comprise a layer of rubber-like material to help create a tighter seal between the top portion and the conventional can. About ⅜th inches upward from edge 54 are a series of posts 56 that assist in stabilizing attachment 10 to the top of container 30. In this embodiment, 11 posts may be used. The number of posts may vary depending upon the size of the attachment and the degree of stability between attachment and container needed. As shown, interior concave surface 60, which corresponds to exterior convex surface 14 on the exterior of attachment 10 (see FIG. 1), curves downward and forwards towards opening 20, in the direction of the arrow, to form the internal reservoir of attachment 10. In addition, interior convex surfaces 70, which correspond to exterior concave side surfaces 16, form funnel surfaces that curve outward into cavity 50 and direct the flow of beverage down into internal reservoir 60. Internal reservoir 60 may vary in depth depending upon the size of attachment 10. In this embodiment, the depth of internal reservoir 60 measured from bottom of funnel surfaces 70 ranges from about one-half to one and one-half inches at its deepest point.

Figure 4:
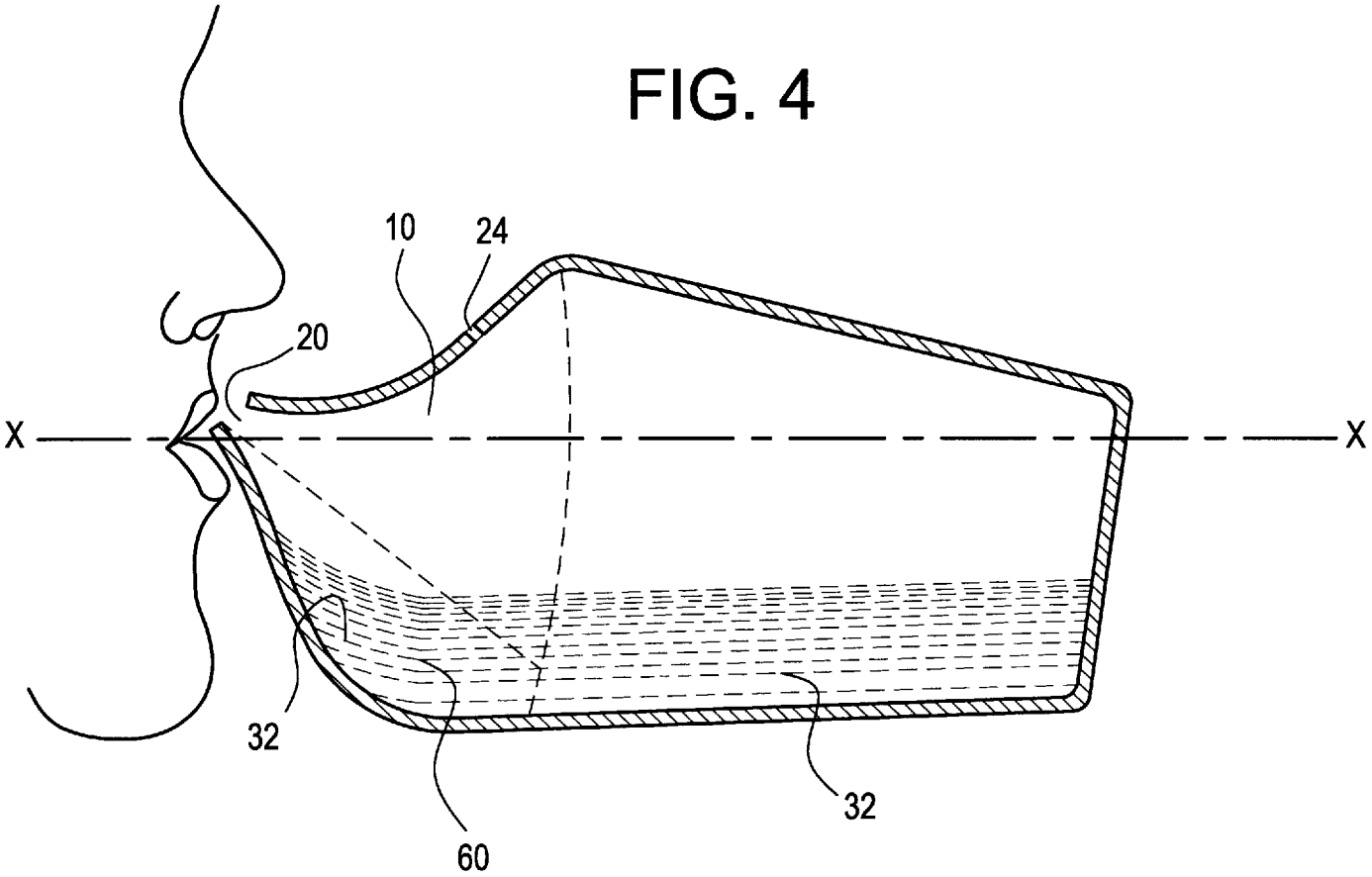
FIG. 4 depicts a cross sectional view of the attachment-beverage container assembly of the present invention about three-quarters full with beverage and being positioned at the mouth of a consumer at a horizontal level.

FIG. 4 is a cross sectional view of attachment 10 fixed to a beverage container about three-quarters fall of beverage 32 and being positioned at the mouth of a consumer at a substantially horizontal level relative to the consumer's mouth. As shown in FIG. 4, when the attachment and beverage assembly is in this position, the beverage 32 is held within internal reservoir 60 without moving through opening 20. FIG. 5 is a cross sectional view of attachment 10 fixed to a beverage container 30 about three-quarters fall of beverage 32, but this time being tilted or lifted at the mouth of a consumer just above the horizontal level. As shown in FIG. 5, when the assembly is titled up to about half inch above the horizontal plane, beverage 32 begins to flow gently through opening 20 into the mouth of the drinker, without rushing into the mouth. It should be noted that the vent 24 on the front side of attachment 10 faces away from the drinker when in use and facilitates and helps smooth the flow of liquid from the container into the drinker's mouth.

Thus, the present invention provides an attachment for converting a conventional beverage container or can into an ergonomical container capable of more fully controlling the dispensing of liquids or other pourable materials for consumption comprising multiple surfaces that provide an internal reservoir and funneling capabilities that allow the consumer to enjoy a gentle and highly controlled means of drinking juices and soft drinks while driving or otherwise on the go. An edge located on the interior surface of the portion near the circular base and a lip on the outer edge of the base provide a means for "snapping" the attachment on and off the container or can, allowing the attachment to be reused. In addition, the relatively small area provided by the opening 20, relative to the overall size of the attachment and container, provides an assembly that greatly contains a liquid or beverage even when the same is dropped or knocked over.

Figure 6:
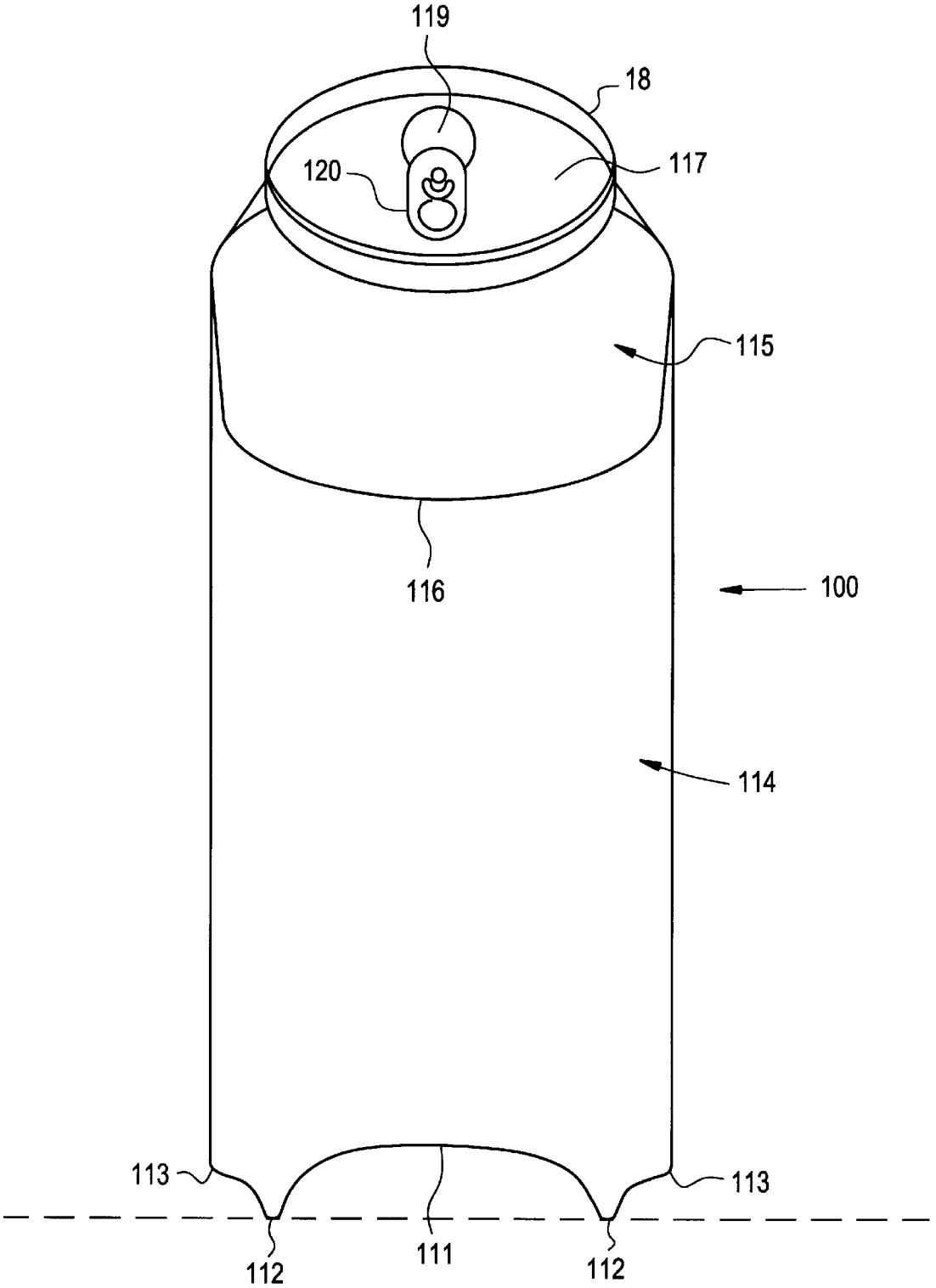
FIG. 6 PRIOR ART
FIG. 6 depicts a perspective view of a beverage can of the prior art.

An alternative embodiment of the present invention modifies conventional aluminum or metal beverage cans to provide the same or similar advantages of attachment 10 above. FIG. 6 shows a conventional straight cylindrical beverage can 100 of the prior art having a base 111 with a circular rim or extension 112 about the base which is used to stabilize the can when it is placed upright on a flat surface, such as a store shelf. Extending upwards from base 111 beginning at about edge 113 is a straight cylindrical portion 114 of can 100 which is hollow so that it can store the beverage to be sold and drunk. At about ⅞ths of an inch up from base 111, the straight cylindrical can portion 114 uniformly narrows to form an inwardly angled top portion 115 extending upward from about edge 116 which is around the circumference of can 100 and substantially parallel to base 111. The straight cylindrical can portion 114 has a generally flat top portion 117 which is sealed about the circumference of the top at cylinder lip 118. Top portion 117 contains a small frangible area 119, which may be round or oval in shape and which is pierced or folded into the interior of the can by the use of a lever 120 so that the contents of the beverage in the container can be poured out or otherwise accessed.

Figure 7:
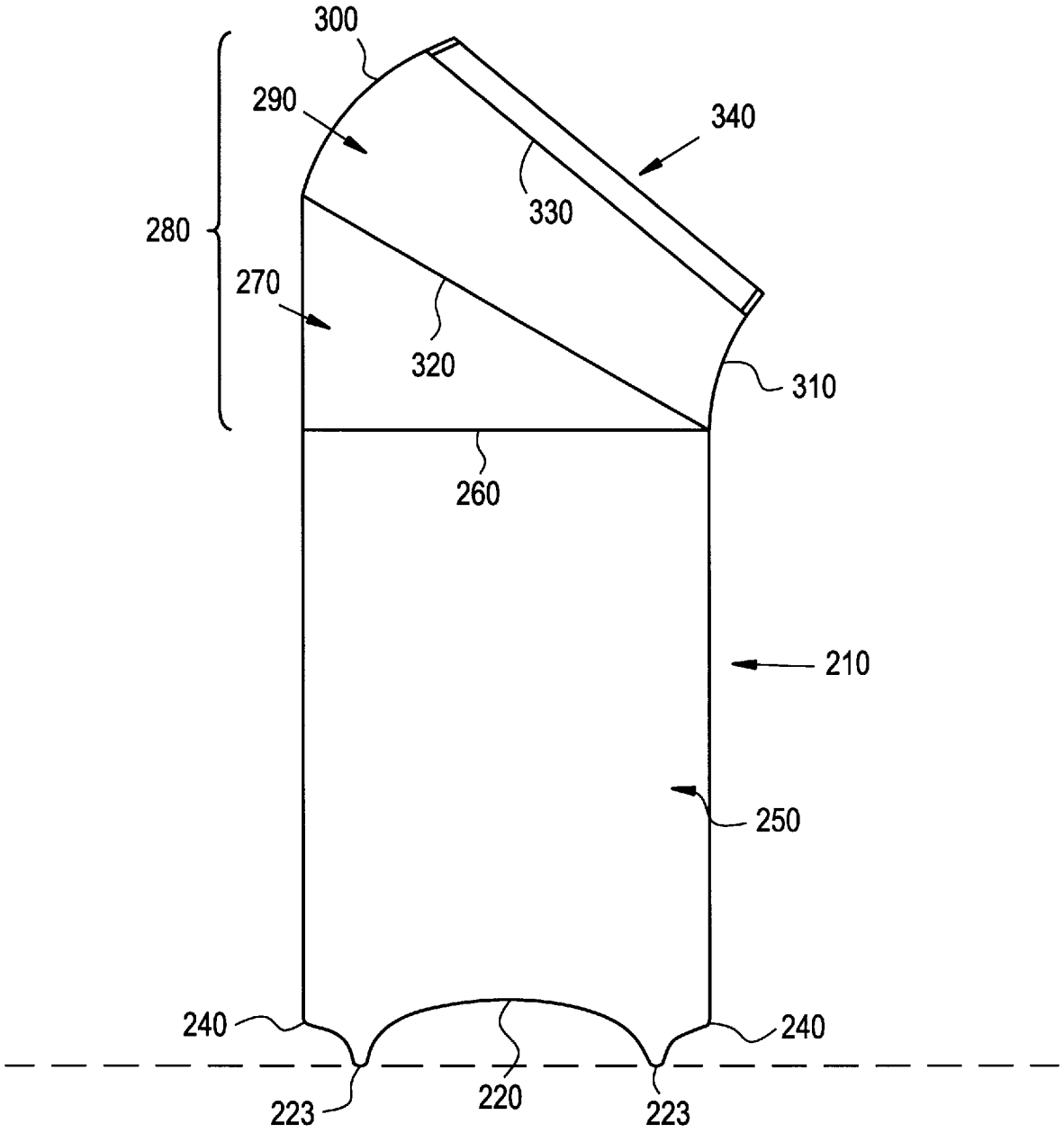
FIG. 7 depicts a side view of a conventional beverage can modified to form an ergonomic top portion.

FIG. 7 is a side-view example of a modified aluminum beverage can of the prior art to provide a curved or beveled beverage container 210, generally. It is constructed to form a substantially circular base 220 with a circular rim or extension 223 extending below and around base 220 for stabilization or support of the container when it is placed in an upright position on a flat surface. Extending vertically from base 220 and beginning at about edge 240 is a first hollow and generally straight cylindrical portion 250 which can be used to store or all part of the beverage, liquid or other material in container 210. The top of generally cylindrical portion 250 forms a circular edge 260 substantially parallel to base 220. Extending upward from edge 260 is a second hollow top portion 280 which forms a generally straight cylindrical portion 270 and beveled or conical cylindrical portion 290 having a generally convex surface 300 and a generally concave surface 310. Convex surface 300 and concave surface 310 are formed in a manner so that they form edges 320 and 330 both of which are sloped relative to base 220. Convex surface 300 provides container 210 with an internal reservoir, similar to that of attachment 10 above, for holding a portion of the exiting beverage during drinking or pouring. A conventional flat top portion 340, like that in FIG. 6 above with frangible area 119 and lever 120, can be sealed about sloped edged 330.

Figure 8:
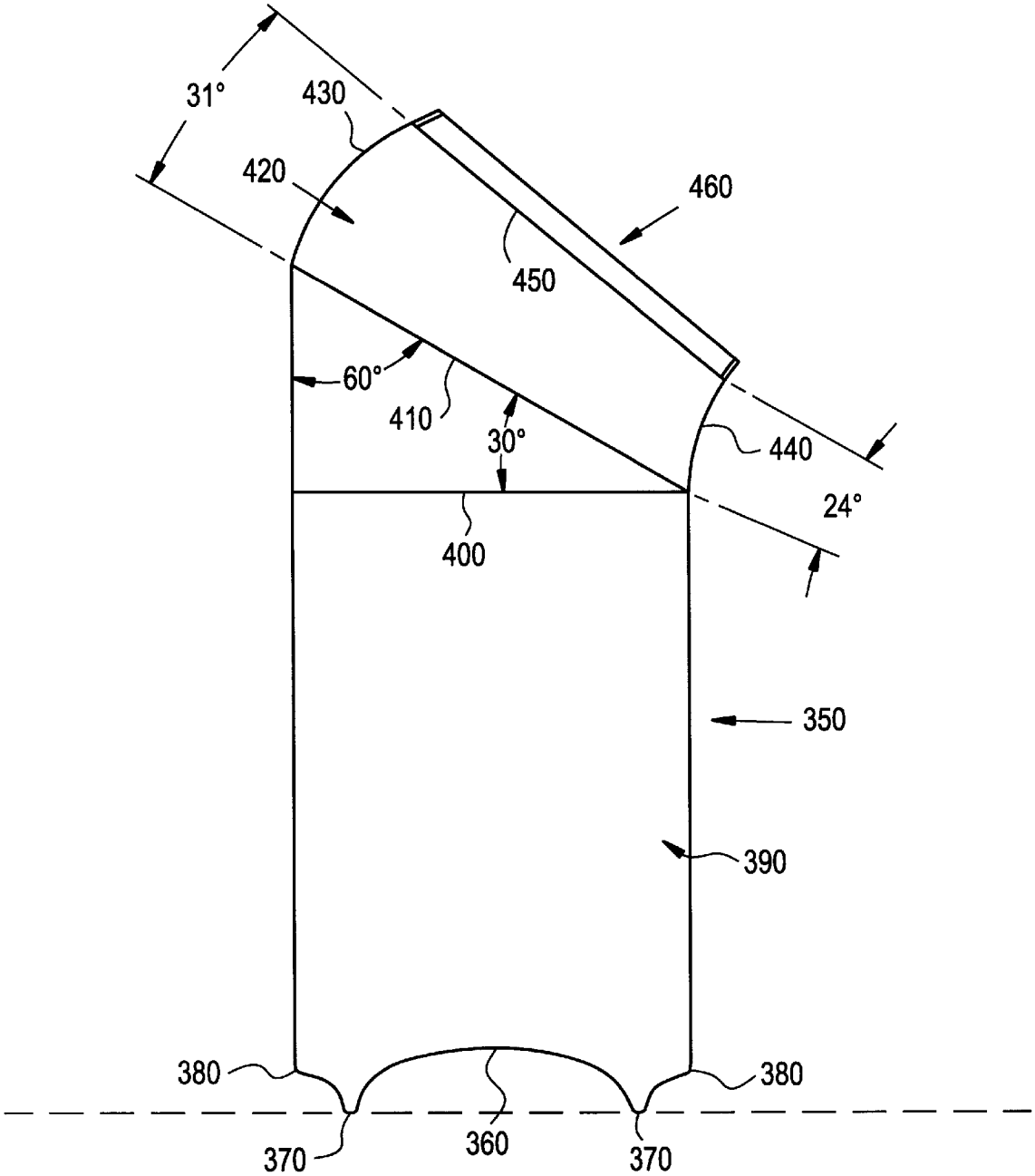
FIG. 8 depicts a side view of a conventional beverage can modified to form an ergonomic top portion with specific dimensions.

FIG. 8 is a further side-view example of a cylindrical beverage container 350 within the scope of the present invention but showing illustrative dimensions of the various surfaces and edges of the container.

This illustration is similar to that depicted in FIG. 7. However, in this case, base 360 is 2.56 inches in diameter as shown Container 350 is 6.69 inches from the base to the highest point at the top where beveled or conical portion 420 terminates. The first straight cylindrical portion 390 of container 350 is about 3.86 inches from edge 380 of base 360 to parallel edge 400 and about 5.34 inches from edge 380 to the point at which beveled or conical portion 420 begins. Edge 410 forms an angle of about 30 degrees with edge 400. Convex surface 430 is beveled to an arc of about 31 degrees but concave surface 440 is beveled to an arc of about 24 degrees so that edge 450 is not parallel to edge 410. As is evident, this design of surfaces provides more room between the drinker's nose and the top of the container when the latter is placed at the drinker's lips. Finally, the diameter of top 460 is about 2.59 inches and may be a conventional top portion, like that in FIGS. 6 and 7 with frangible area 119 and lever 120.

An aluminum or metal container of the present invention can be constructed by starting with a conventional beverage can such as that depicted in FIG. 6, e.g., a basic 12-ounce aluminum or aluminum alloy beverage can First, referring again to FIG. 6, a generally straight line is cut with a fine blade at about edge 116 so as to separate the top portion 115 from the rest of the can. Then, top portion 115 is modified (with metal-working tools or other suitable implements available to those skilled in metal-working) by shaping the metal to form a beveled section like that depicted at FIG. 6, 290, with a convex surface 300 and concave surface 310. The entire section need not be beveled but part of it can remain straight, as is depicted in FIG. 7 at 280. Alternatively the top portion of the can be shaped, for example, in a cannery, by using a molding process that utilizes a die or mold to fabricate the surfaces depicted at FIG. 7, 280. Also, standard vacuum sealing processes can be used to attach and seal a modified top portion such as that in FIG. 7, 280, to edge 260.

As is demonstrated in the above illustrative examples, the attachment and containers of the present invention are more ergonomic than the containers of the prior art by virtue of the employment of beveled or curved sections that permit a drinker to fully consume the contents of the container without having to tilt her head backwards. Moreover, the use of a novel internal reservoir, together with curved funnel-type surfaces, provide the consumer with great control over the volume and rate of flow of the contents of the beverage container.

I claim:

1. A hollow and substantially rigid container attachment for converting a conventional liquid container, having a top with an opening therein, into an ergonomical container capable of more fully controlling the drinking of liquids, said attachment comprising:

(a) a base having a size and configuration corresponding to the size and configuration of the top of said container such that when the container and attachment are upright, the base is attachable to the top of the container;

(b) at least one sidewall extending upwardly from the base and forming a top drinking opening with the upper edges of the sidewall surface;

(c) a reservoir formed by said at least one sidewall within the interior of said attachment;

(d) said reservoir being sufficiently capacious so as to permit the attachment and container to contain therein all of the liquid initially within the container, when said container is completely filled with said liquid, without said liquid exiting from said drinking opening when the container is placed in a horizontal position relative to the face of the drinker; and wherein the drinking opening is substantially in line with a longitudinal axis of the container which extends through the top of the container.

2. A container attachment of claim 1 wherein the attachment is at least partially fabricated from a plastic or polymeric material.

3. A container attachment of claim 1 wherein the attachment is at least partially fabricated from a paper product.

4. A container attachment of claim 1 wherein the attachment is at least partially fabricated from a metal or metal alloy.

5. The attachment of claim 1 further comprising at least one outwardly curved surface formed within the interior of the attachment.

6. A container attachment of claim 5 wherein the attachment is at least partially fabricated from a plastic or polymeric material.

7. A container attachment of claim 5 wherein the attachment is at least partially fabricated from a paper product.

8. A container attachment of claim 5 wherein the attachment is at least partially fabricated from a metal or metal alloy.

* * * * *